United States Patent [19]

Schoenke

[11] Patent Number: 4,486,919

[45] Date of Patent: Dec. 11, 1984

[54] DOUBLE PIVOTING HINGE HAVING INTERCHANGEABLE BRACKETS

[75] Inventor: Ronald O. Schoenke, Milwaukee, Wis.

[73] Assignee: Johnson Service Company, Milwaukee, Wis.

[21] Appl. No.: 444,463

[22] Filed: Nov. 24, 1982

[51] Int. Cl.[3] ..... E05D 3/06; E05D 5/06

[52] U.S. Cl. ..... 16/366; 16/389

[58] Field of Search ..... 16/265, 271, 365, 366, 16/370, 386, 387, 389, 390, 391, 378, 379

[56] References Cited

U.S. PATENT DOCUMENTS

| | | | |
|---|---|---|---|
| 702,640 | 6/1902 | Dyer | 16/391 |
| 2,372,431 | 3/1945 | Kahle | 16/389 X |
| 2,808,610 | 10/1957 | Minor | 16/365 |
| 3,619,853 | 11/1971 | Merrill | 16/271 X |
| 3,710,416 | 1/1973 | Phelps | 16/390 |

FOREIGN PATENT DOCUMENTS

| | | | |
|---|---|---|---|
| 811562 | 8/1951 | Fed. Rep. of Germany | 16/366 |
| 1939377 | 2/1971 | Fed. Rep. of Germany | 16/366 |
| 690343 | 9/1930 | France | 16/366 |

*Primary Examiner*—Fred A. Silverberg

*Attorney, Agent, or Firm*—Larry L. Shupe; Joseph J. Jochman, Jr.; John Phillip Ryan

[57] ABSTRACT

The hinge of the present invention comprises an I-shaped support bracket including an elongage body member and a plurality of laterally extending flanges. A panel bracket is adapted for attachment to a generally planar panel member and includes means for pivotably coupling the panel bracket to the flanges along a first pivot axis. A door bracket is provided for attachment to a generally planar door member and includes means for pivotably coupling the door member to the flanges along a second pivot axis. When closed, the supported door member is disposed in a reference plane and in generally normal, edgewise relationship to the panel member. The support bracket, panel bracket and door bracket cooperate during door opening and closing for permitting lateral door movement generally parallel to the reference plane. The panel bracket and the door bracket may optionally be configured to be interchangeable one with the other.

2 Claims, 3 Drawing Figures

DOUBLE PIVOTING HINGE HAVING INTERCHANGEABLE BRACKETS

BACKGROUND OF THE INVENTION

This invention relates to hinges and more particularly to a double pivoting door hinge which may be entirely concealed, may be adapted for use with planar cabinet and door members and permits retentive closure of the door member by underlapping engagement thereof with a portion of the surrounding cabinet.

One example of a known double pivoting door hinge is arranged for use with cabinet and door panels, each having a plurality of right angularly formed corner sections adapted for attachment to the hinges. In this configuration, portions of the hinge and the associated door or cabinet panels cooperate for limiting the degree of angular door swing. Hinges of this type necessitate that the hinge itself and the associated cabinet and door panels be unnecessarily complex. An example of such a hinge is shown in U.S. Letters Pat. No. 3,619,853. Another type of known, double pivot hinge incorporates a U-shaped main member and a plurality of dissimilar supporting brackets which are coupled to specially configured cabinets and doors. An example of a hinge of this type is shown in U.S. Letters Pat. No. 2,372,431. Cabinets equipped with hinges of either of the aforementioned types require separate latching hardware for retentive door closure.

While these prior art hinges have heretofore provided satisfactory means for pivoting door support, they have failed to appreciate the manner in which a double pivoting hinge may be adapted for use with substantially planar cabinet panels and doors associated therewith.

A double pivoting hinge which is adapted to be used with generally planar cabinet and door members and which permits both swinging movement for door opening and lateral movement for providing underlapping, closure retaining engagement of the door distal edge with the adjacent cabinet panel would be a significant advance over the prior art.

SUMMARY OF THE INVENTION

In general, the hinge of the present invention comprises an I-shaped support bracket including an elongate body member and a plurality of laterally extending flanges. A panel bracket is adapted for attachment to a generally planar panel member and includes means for pivotably coupling the panel bracket to the flanges along a first pivot axis. A door bracket is provided for attachment to a generally planar door member and includes means for pivotably coupling the door member to the flanges along a second pivot axis. When closed, the supported door member is disposed in a reference plane and in generally normal, edgewise relationship to the panel member. The support bracket, panel bracket and door bracket cooperate during door opening and closing for permitting lateral door movement generally parallel to the reference plane. The panel bracket and the door bracket may optionally be configured to be interchangeable one with the other.

It is an object of the invention to provide a new and improved hinge for supporting a door.

Yet another object of the invention is to provide a double pivoting hinge which may be adapted to panel members and door members having a generally planar configuration.

Still another object of the present invention is to provide a hinge which permits both lateral door movement for unlatching and swinging movement for door opening.

Yet another object of the present invention is to provide a double pivoting hinge including a panel bracket and a door bracket which are interchangeable one with the other. These and other objects of the present invention will become more apparent from the detailed description thereof taken with the accompanying drawing.

DESCRIPTION OF THE PREFERRED EMBODIMENT

Figure 1:
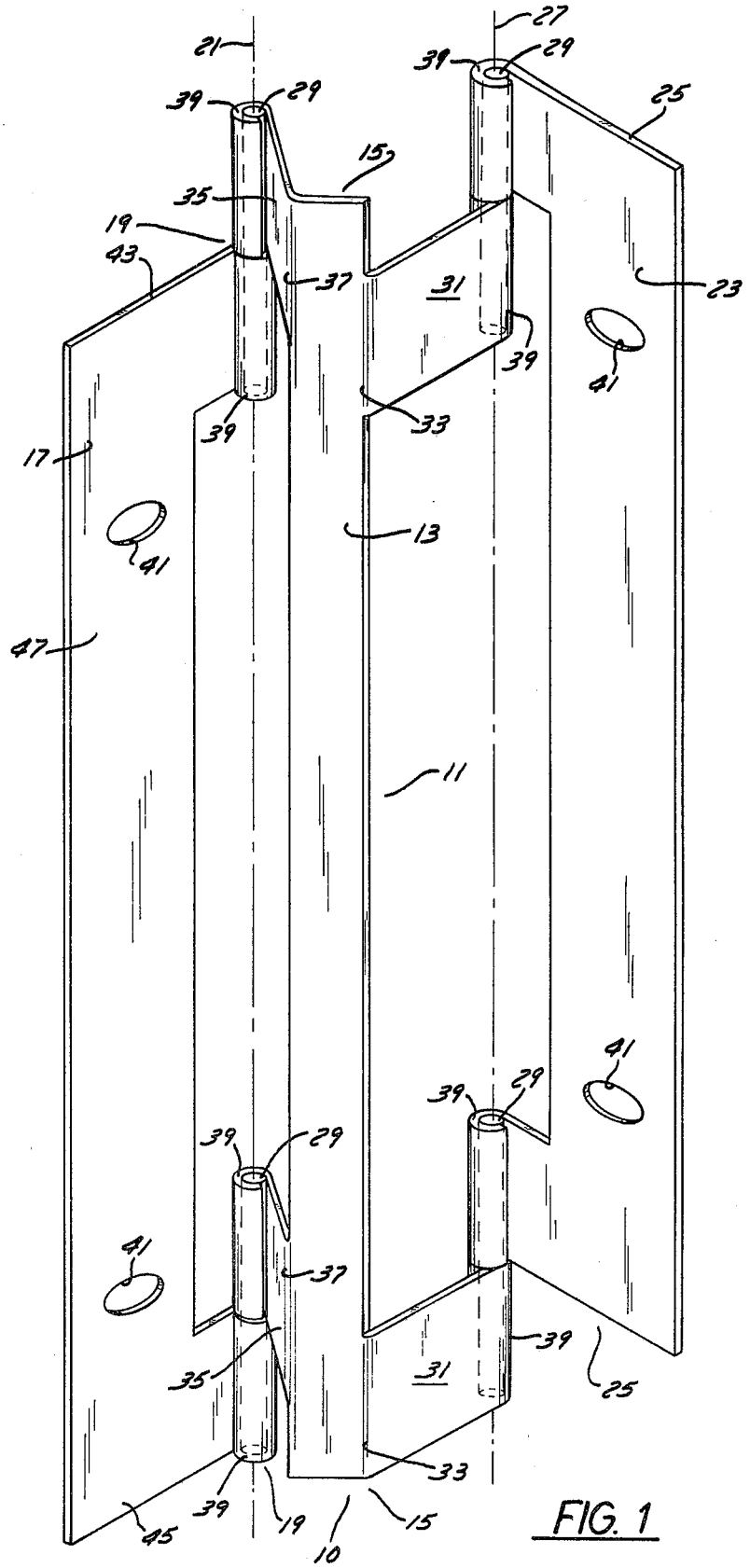
FIG. 1 is a perspective elevation view of the hinge according to a preferred embodiment of the invention with portions shown in phantom.

In FIG. 1, the hinge 10 is shown to include a generally I-shaped support bracket 11 having an elongate, generally planar body 13 and a plurality of laterally extending flanges 15. A panel bracket 17 is adapted for attachment to a generally planar, stationary panel member and includes panel clevis means 19 for pivotably coupling the panel bracket 17 to the support bracket flanges 15 along a first pivot axis 21. A door bracket 23 is adapted for attachment to a generally planar, movable door member and includes door clevis means 25 for pivotably coupling the door bracket 23 to the support bracket flanges 15 along a second pivot axis 27. Coupling of the brackets 17, 23 and the flanges 15 is by a plurality of cylindrically shaped pivot pins 29.

More particularly, each of the support flanges 15 includes a generally planar door leg 31 formed of a rigid material and having its first end 33 securely attached to the body 13 to define substantially a right angle therebetween. Each flange 15 also includes a generally planar panel leg 35 formed of a rigid material and having its first end 37 securely attached to the body 13 to define an obtuse angle therebetween with an angle of 135° being preferred. Each of the legs 31, 35 includes a support scroll 39 at its outer terminus, the scroll 39 being formed by a curled end defining a generally cylindrically shaped cavity for receiving a pivot pin 29.

It will be appreciated by one of ordinary skill in the art that the panel bracket 17 and the door bracket 23 may be of disparate shape and may have mounting holes 41 of disparate size and location so long as the location of the scrolls 39 of the door bracket 23 and of the panel bracket 17 are selected to simultaneously abut the scrolls 39 of the support flanges 15. However, manufacturing, assembly and inventory economies will result if the door bracket 23 and the panel bracket 17 are identically formed as shown in a preferred embodiment. Accordingly, only the panel bracket 17 will be described in detail and is shown to include a first, generally planar upper extension 43, a second, generally planar lower extension 45 and a planar linking member 47 connected therebetween and at generally right angles thereto. Each of the extensions 43, 45 includes a scroll 39 of the aforementioned configuration and disposed at the outer terminus thereof. The linking member 47 includes a plurality of mounting apertures 41 for attachment of the bracket 17 to the associated panel. Assembly and alignment of the finished structure will be facilitated if the mounting apertures 41 are formed to define ellipses. Mounting of the brackets 17, 23 to their associated panels may be by any convenient means as, for example, by bolts 49 and retaining nuts 51 as shown in FIG. 2.

It will also be appreciated by one skilled in the art that, with respect to the pair of scrolls 39 defining each of the four illustrated joints, the pivot pin 29 associated with each joint is preferably to be securely retained within one scroll 39 to permit pivoting movement upon the pin 29 by the other. Symmetry of the panel bracket 17 and the door bracket 23 will be preserved by securely retaining the four pivot pins 29 within those scrolls 39 comprising portions of the support bracket 11 or, in the alternative, by providing for pin retention at the scrolls 39 of the door bracket 23 and the panel bracket 17.

Figure 2:
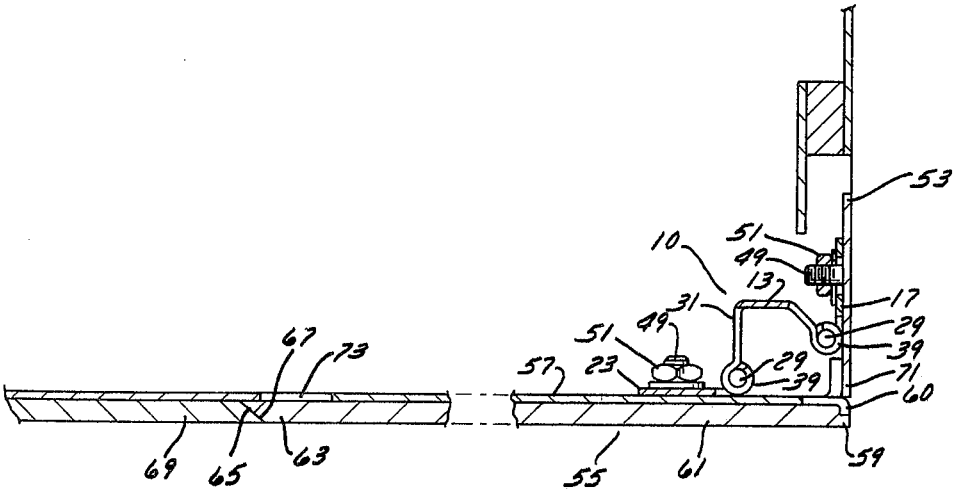
FIG. 2 is a top plan view of the hinge of FIG. 1 shown in conjunction with the associated cabinet face, cabinet member and pivotably supported door member with portions shown in cross section.

Referring next to FIG. 2, the hinge 10 is shown in conjunction with a stationary panel member 53 to which the panel bracket 17 is fixed. A generally planar door member 55 is disposed in an edgewise relationship to the panel member 53 and generally normally thereto. While the door member 55 may be formed of a single sheet of any suitably rigid material, the door member 55 of the illustrated embodiment is formed of a rigid, generally planar backing piece 57 having its inward edge 59 bent forwardly to define a grasping lip 60. The backing piece 57 may be faced with virtually any other material which may be caused to adhere thereto as, for example, a sheet of clear or colored plastic 61. The distal edge 63 of the door member 55 includes a beveled lip 65 for underlapping closely fitted engagement with a beveled lip 67 of the cabinet face 69. Underlapping engagement of the door member 55 and the face 69 as shown and described will prevent the door member 55 from swinging outwardly when in the illustrated closed position. Retention of the door member 55 in a closed position will be facilitated if the forward edge 71 of the panel member 53 and the grasping lip 60 of the door member 55 are constructed and arranged for slight frictional engagement when the door member 55 is closed.

Figure 3:
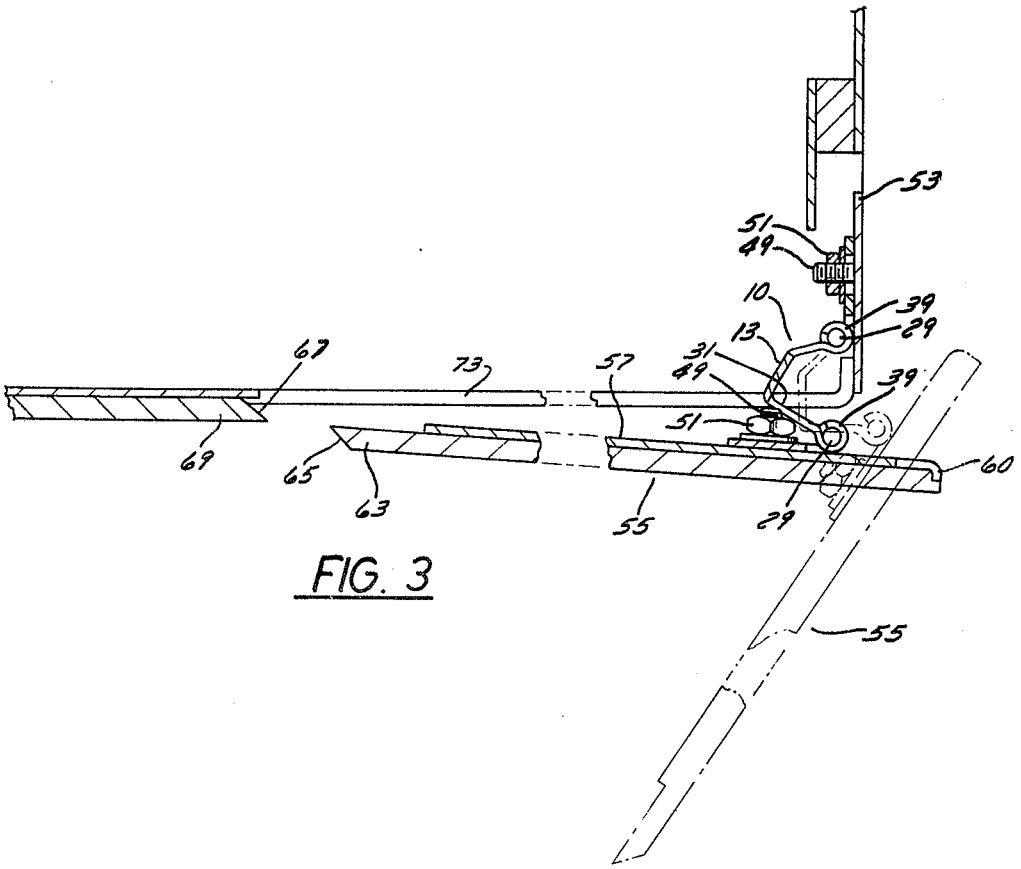
FIG. 3 is a top plan view of the structure of FIG. 2 with the supported door member shown in an initial door unlatching position in solid, in a door opening position in dashed phantom and with portions shown in cross section.

Referring next to FIGS. 2 and 3, the unique configuration of the inventive hinge 10 permits the door member 55 to be grasped lightly at its grasping lip 60, drawn slightly outwardly to approximately the solid line position shown in FIG. 3 and then laterally rightwardly along a plane generally parallel to a reference plane defined by the door member 55 when in the closed position of FIG. 2. Outward and lateral door member movement as described will permit the beveled lip 65 of the door member 55 to be disengaged from the face lip 67 and thereafter the door member 55 may be pivoted through the positions shown in the solid and dashed lines of FIG. 3 to a fully open position whereupon the grasping lip 60 contacts the exterior surface of the panel member 53. It is to be appreciated that the horizontal edge 73 of the cabinet frame depicted in FIG. 3 is, when viewed in elevation, in general position correspondence with the lower horizontal edge of the door member 55.

From the foregoing description taken in conjunction with the drawing, one of ordinary skill in the art will appreciate that the panel member 53, door member 55 and cabinet face 69 may be formed as simple, substantially planar structures. Further, a cabinet constructed using the teachings of the present invention will have its hinge 10 wholly concealed therewithin, will present a smooth, highly attractive appearance to the viewer and will avoid the necessity of incorporating auxiliary latching hardware, knobs or handles and the like which would otherwise be required for opening or retentive closure of the door member 55.

While only a single preferred embodiment of the invention has been shown and described, it is not intended to be limited thereby but only by the scope of the appended claims.

I claim:

1. A concealed hinge for pivotably supporting a door member in a generally edge-abutting and perpendicular relationship to a panel member and comprising:

an elongate generally planar body member having a longitudinal axis and having a first end with a first support flange laterally disposed adjacent thereto, a second end with a second support flange laterally disposed adjacent thereto and spaced from said first support flange;

said first support flange and said second support flange each including a planar door leg affixed to said body to define substantially a right angle therebetween and a planar panel leg affixed to said body to define an obtuse angle therebetween, wherein the legs extend outwardly from the same side of the elongate body member in a diverging direction;

each leg of said first support flange and said second support flange including means disposed at its outer terminus and adapted to be pivotably coupled to a bracket;

a panel bracket having planar spaced upper and lower extensions and being, coupled to a panel member and including means on said extensions for pivotable attachment to said panel legs along a first pivot axis, said first axis being spaced apart from the proximal edge of said panel member;

a door bracket having planar spaced upper and lower extensions and being, coupled to a door member and including means on said extensions for pivotable attachment to said door legs along a second pivot axis, said second axis being spaced apart from the proximal edge of said door member;

said hinge thereby being adapted to permit said door member to be opened by grasping at said door member proximal edge; said planar panel leg at the first end being longitudinally, outwardly spaced along the longitudinal axis from said planar door leg, and said planar door leg at the second end being longitudinally, outwardly spaced along the longitudinal axis from said planar panel leg to allow the panel bracket and the door bracket to be interchangable with each other.

2. The invention set forth in claim 1 wherein said obtuse angle is between 100° and 150°.

* * * * *

UNITED STATES PATENT AND TRADEMARK OFFICE

CERTIFICATE OF CORRECTION

PATENT NO. : 4,486,919

DATED : December 11, 1984

INVENTOR(S) : Ronald O. Schoenke

It is certified that error appears in the above–identified patent and that said Letters Patent are hereby corrected as shown below:

Column 4, Line 42, delete ---,---

Column 4, Line 48, delete ---,---

Signed and Sealed this

*Seventh* Day of *May 1985*

[SEAL]

*Attest:*

DONALD J. QUIGG

*Attesting Officer* *Acting Commissioner of Patents and Trademarks*